US006407354B1

(12) United States Patent
Turner et al.

(10) Patent No.: US 6,407,354 B1
(45) Date of Patent: Jun. 18, 2002

(54) ELECTRICAL SWITCHING APPARATUS INCLUDING A BAFFLE MEMBER HAVING A DEFLECTABLE FLAP

(75) Inventors: David Curtis Turner, Imperial; Craig Joseph Puhalla, Moon Township; Ramon Javier Ojeda; Ralph Mason Ennis, both of Imperial, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/840,259

(22) Filed: Apr. 23, 2001

(51) Int. Cl.[7] ..... H01H 9/30
(52) U.S. Cl. ..... 218/155; 335/202; 218/157
(58) Field of Search ..... 335/6, 8–10, 132, 335/202, 201; 439/810–814; 200/293–308; 218/157, 154–156, 147

(56) References Cited

U.S. PATENT DOCUMENTS 4,620,076 A 10/1986 Mrenna et al.
4,631,376 A * 12/1986 Leone ..... 200/306
4,638,277 A 1/1987 Thomas et al.
4,650,940 A 3/1987 Grunert et al.
5,317,117 A 5/1994 Bruski et al.
5,493,092 A 2/1996 Rowe
5,589,672 A * 12/1996 Uchida et al. ..... 218/34
5,753,877 A 5/1998 Hartzel et al.
5,753,878 A 5/1998 Doughty et al.
5,811,749 A 9/1998 Bausch et al.
6,002,313 A 12/1999 Mrenna et al.
6,188,036 B1 2/2001 Arnold

* cited by examiner

*Primary Examiner*—Lincoln Donovan
(74) *Attorney, Agent, or Firm*—Martin J. Moran

(57) ABSTRACT

A circuit breaker includes an electrically insulating housing, an arc chamber, line and load terminals, separable contacts in series with the terminals, and an operating mechanism. The open position of the separable contacts causes arcing therebetween and the development of ionized gases. The housing includes a first wall, an opposite second wall, a pair of side walls, and a barrier wall forming a compartment for containing the line terminal. The barrier wall has an opening between the arc chamber and the compartment. The first wall has an aperture aligned with the line terminal. A baffle member includes a base portion, a flap and a pair of leg members. The flap extends over the aperture and is deflectable by a tool inserted through the aperture for adjustment of the line terminal. The leg members engage the side walls, thereby supporting the baffle member within the compartment.

20 Claims, 5 Drawing Sheets

ELECTRICAL SWITCHING APPARATUS INCLUDING A BAFFLE MEMBER HAVING A DEFLECTABLE FLAP

BACKGROUND OF THE INVENTION

1. Field of the Invention

This invention relates to electrical switching apparatus and, more particularly, to circuit breakers, such as a molded case circuit breaker having a barrier for avoiding electrical breakdown due to ionized gases exhausting from an arc extinguishing chamber.

2. Background Information

Electrical switching apparatus include, for example, circuit switching devices and circuit interrupters, such as circuit breakers, network protectors, disconnects, transfer switches, and motor circuit protectors.

Circuit breakers are generally old and well known in the art. Examples of circuit breakers are disclosed in U.S. Pat. Nos. 4,620,076; 4,638,277; 4,650,940; 5,493,092; and 5,753,877.

When the circuit breaker's separable contacts are opened, an arc is usually created which is accompanied by the generation of ionized gases. This is particularly true for circuit breakers of small physical size with high interrupting ratings. The ionized gases are conductive. Hence, if such gases collect in the vicinity of the line terminals of the circuit breaker, they may cause a phase-to-phase electrical failure between the circuit breaker terminals, and/or a phase-to-ground electrical failure with any metallic enclosure within which the circuit breaker is mounted. This can lead to electrical faults on the line side of the circuit breaker and damage to switchgear equipment.

Circuit breakers typically include vents to allow the ionized gases to quickly escape therefrom. Where wiring terminals are in close proximity to the circuit breaker vents, the problem of electrical faults is especially acute. Accordingly, there is a need for preventing these kinds of electrical breakdowns.

U.S. Pat. No. 4,650,940 discloses a circuit breaker having a flap or barrier, which is disposed within a terminal compartment and over the inner side of an opening for a screwdriver. The ionized gases flowing into the terminal compartment are stopped from flowing through the opening by the flap extending thereacross. The flap is preferably composed of a sheet of fiber or fiber type material, which is chemically and electrically impervious to hot ionized gases. The fiber sheet is folded into a configuration including a central wall portion, an upper foldable flap portion and a lower T-shaped portion. The central wall portion and the lower T-shaped portion are adapted to fit snugly against a compartment wall and an opening from the circuit breaker arc chute. A suitable adhesive is provided between the wall surfaces and the corresponding central wall portion and lower T-shaped portion to retain the folded sheet in place. However, because the fiber sheet is not coupled to the wall or to the terminal collar assembly, it can easily be accidentally removed, thereby allowing a path for ionized gases to reach ground through the screwdriver opening.

Accordingly, there is room for improvement in circuit breakers employing terminal barriers.

SUMMARY OF THE INVENTION

These needs and others are satisfied by the invention, which is directed to an electrical switching apparatus, such as a circuit breaker, including a baffle member for arc gases.

The baffle member includes a base portion, a flap and a pair of leg members, with the flap extending over a terminal aperture and being deflectable by a tool inserted through the aperture for adjustment of the terminal. The leg members engage terminal compartment side walls and support the baffle member within the terminal compartment.

As one aspect of the invention, an electrical switching apparatus for automatically interrupting an overload current comprises: an electrically insulating housing; an arc chamber within the housing; line and load terminals; separable contacts in series with the line and load terminals; an operating mechanism for moving the separable contacts between an open position and a closed position, the open position of the contacts causing arcing therebetween and the development of ionized gases; the housing including a plurality of walls forming a compartment for containing one of the terminals, with a first wall having an aperture for accessing the one of the terminals and a second wall having an opening between the chamber and the compartment, and a baffle member comprising a base portion, a flap and a pair of leg members, the flap extending over the aperture and being deflectable by a tool inserted through the aperture for adjustment of the one of the terminals, the leg members engaging some of the walls of the compartment, thereby supporting the baffle member within the compartment.

Preferably, the compartment includes a member having protruding portions and each of the leg members has a cut out portion which mates with a corresponding one of the protruding portions.

The baffle member may be a flat member which is folded three times to form the flap and the pair of leg members, with the flap and the leg members each being folded with respect to the base portion.

As another aspect of the invention, a circuit breaker comprises: an electrically insulating housing; line and load terminals; separable contacts within the housing and electrically connected between the line and load terminals; an arc chamber within the housing; and an operating mechanism adapted to move the separable contacts between open and closed positions within the chamber, the housing including a first wall, an opposite second wall, a pair of side walls, and a barrier wall forming a compartment for containing one of the terminals, the barrier wall having an opening between the chamber and the compartment, the first wall having an aperture for accessing the one of the terminals; and a folded baffle member comprising a base portion, a flap and a pair of leg members, the flap extending over the aperture to prevent arc gases from flowing through the aperture and thereby avoiding a phase-to-ground electrical breakdown between the one of the terminals and an electrical conductor adjacent to the aperture, the flap being deflectable by a tool inserted through the aperture for adjustment of the one of the terminals, the leg members engaging the pair of side walls, thereby supporting the baffle member within the compartment.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention, preferably, is an electrical switching apparatus, which automatically interrupts an overload current, such as a circuit breaker or a motor circuit protector. However, for purposes of illustration, the present invention is explained within the parameters of a molded case circuit breaker having three poles, although the invention is applicable to circuit breakers having one or more poles.

Figure 1:
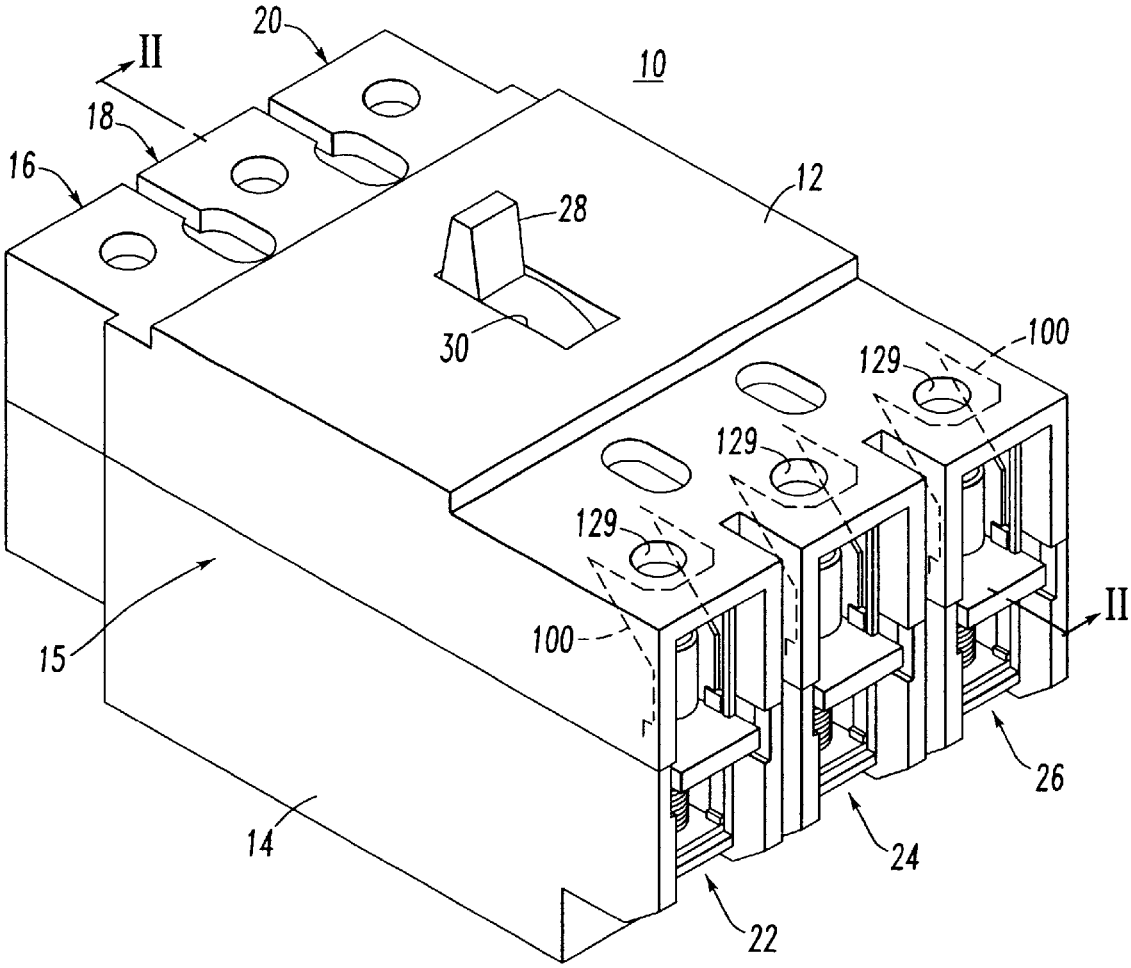
FIG. 1 is an isometric view of a circuit breaker having a barrier structure in accordance with the present invention.

In FIG. 1, a three-phase molded case circuit breaker 10 includes an electrically insulated housing comprising molded cover 12 and a similarly molded base 14. The molded cover 12 and molded base 14 form a molded case 15. For the three phases, three load terminals 16,18,20 and three line terminals 22,24,26 are provided, where load terminal 16 is related to line terminal 22, load terminal 18 is related to line terminal 24, and load terminal 20 is related to line terminal 26. A handle 28 for manually opening and closing the circuit breaker 10 extends through opening 30 in cover 12.

The construction and operation of the circuit breaker 10 may be similar to that of U.S. Pat. Nos. 4,638,277; 4,650,940; 5,493,092; and 5,753,877, which are incorporated herein by reference.

Figure 2:
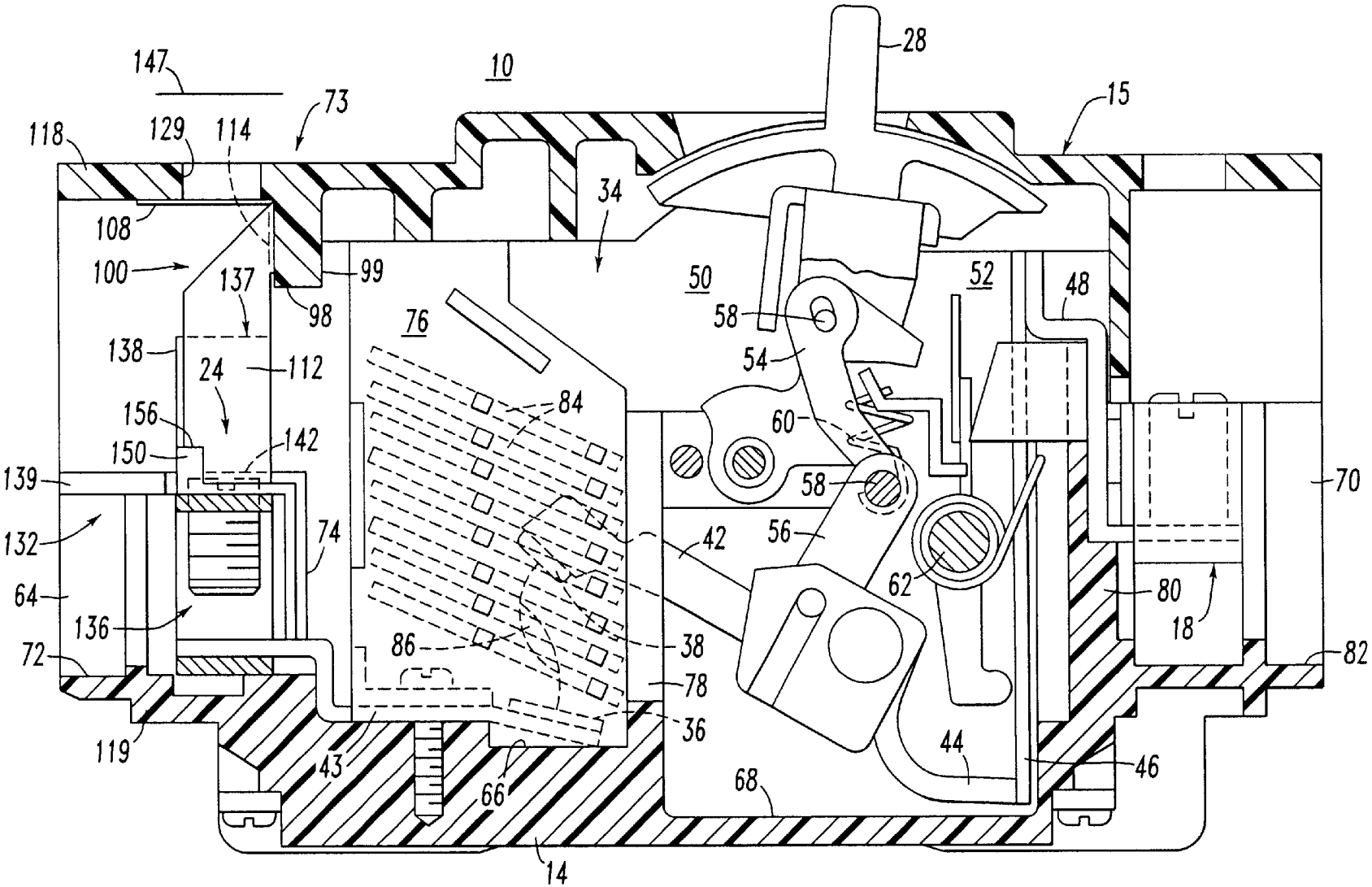
FIG. 2 is a generally vertical sectional view taken along lines II—II of FIG. 1 showing the operating mechanism in the OFF position and the barrier structure blocking the flow of arc gases.

As shown in FIG. 2, a circuit breaker mechanism 34 is provided within the molded case 15 for interconnection between the line terminal 24 and the load terminal 18. The circuit breaker mechanism 34 includes a fixed contact 36 and a movable contact 38. The fixed contact 36 is welded on the line terminal 24, and the movable contact 38 is mounted on a contact arm 42 and is movably operable relative to the contact 36 depending on the status of the circuit breaker mechanism 34. The electric circuit through the circuit breaker 10 extends from the line terminal 24 to the load terminal 18 by way of a line conductor 43, the separable contacts 36,38, the contact arm 42, a flexible conductor or shunt 44, a bimetal element 46, and a load conductor 48, when the contacts 36,38 are closed.

The circuit breaker mechanism 34 includes a support assembly 50 and an operating mechanism 52 comprising a center toggle linkage including links 54,56, which are pivotally connected at pivot pin 58, to which coil spring 60 is connected, and a trip bar 62 which is activated by bimetal element 46, in order to automatically interrupt an overload current flowing through the closed contacts 36,38.

Each of the three poles of the exemplary circuit breaker 10 constitutes a chamber having several compartments 64,66, 68,70 in FIG. 2.

Still referring to FIG. 2, terminal 24 is disposed in compartment 64 between an access opening 72 and a partition 73 formed by a barrier wall 99 and a partition portion 74. An arc chute 76 is disposed between partitions 73 and 78 of compartment or arc chamber 66. The operating mechanism 52 is disposed between partitions 78 and 80 of compartment 68, and the load terminal 18 is located between partition 80 and an access opening 82. Thus, the several parts 24, 76, 52, and 18 are disposed respectively in separate compartments 64, 66, 68, and 70, and each partition 73, 78, and 80 is provided with openings (such as opening 98 between compartments 64 and 66) for interconnecting the several parts discussed hereinabove in a manner well known to those skilled in the art.

In the usual manner, the arc chute 76 includes a plurality of spaced deionization plates 84, which surround the movable contact 38 as it moves away from fixed contact 36 in order to extinguish an arc 86 extending therebetween. As a result, ionized gases occur which require venting to the outside of the circuit breaker 10 to minimize related problems that otherwise may occur. The gases are vented from the arc chute 76 at opening 98, which is adjacent line terminal 24 and below barrier wall 99.

Figure 3:
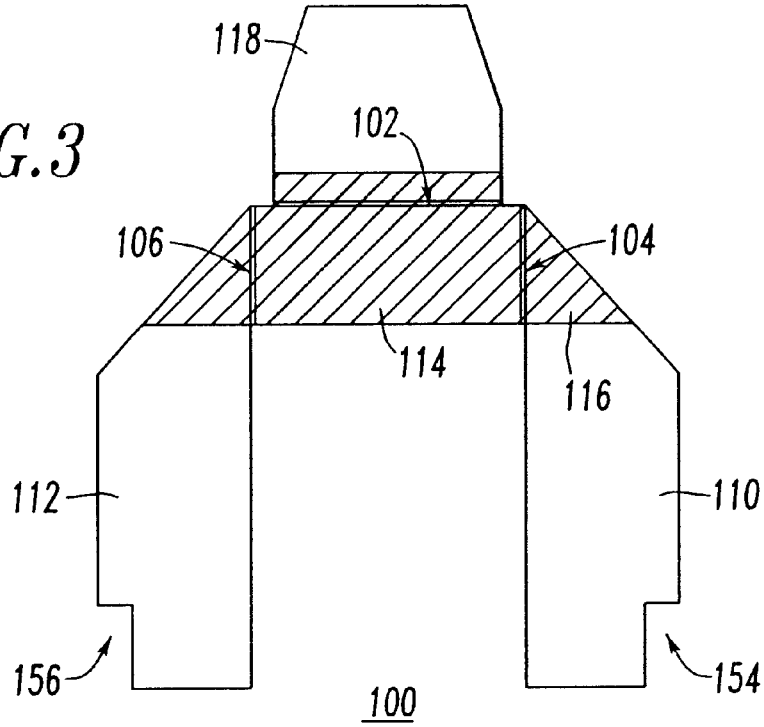
FIG. 3 is a reverse plan view of the barrier structure of FIG. 1, which has not yet been folded.
Figure 4:
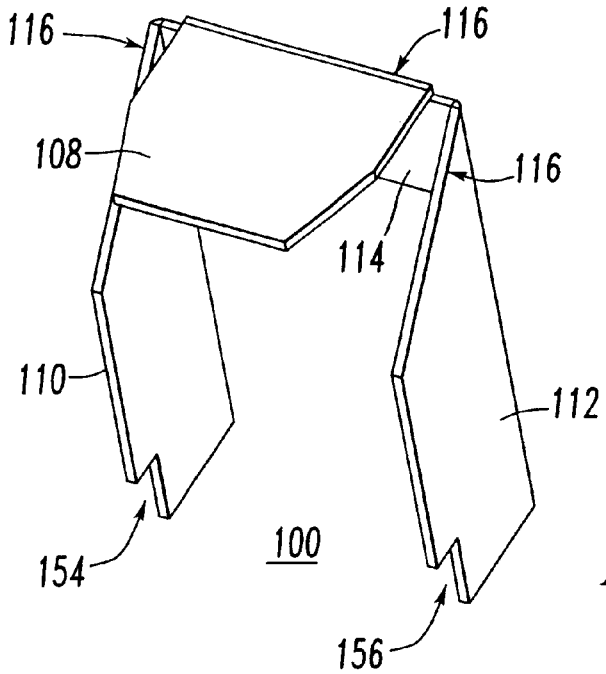
FIG. 4 is an isometric view of the barrier structure of FIG. 1, which has been folded.

Referring to FIGS. 3 and 4, a barrier structure in the form of the exemplary baffle member 100 is shown. As shown flat and unfolded in FIG. 3, the rear side of the member 100 includes three perforated portions 102,104,106 to form three folds. As shown in FIG. 4, the member 100 is folded three times to form a flap 108 and a pair of leg members 110,112, with the flap 108 being folded at the perforated portion 102, and the leg members 110,112 being folded at the respective perforated portions 104,106, with respect to a base portion 114.

The member 100 is preferably composed of a sheet of fiber or fiber sheet material (e.g., a vulcanized sheet of fiber), which is chemically and electrically impervious to the hot ionized gases to which it is exposed. A suitable adhesive, such as the exemplary double-sided tape 116, may be provided on portions of the leg members 110,112, a portion of the flap 108, and preferably all of the base portion 114.

Figure 5:
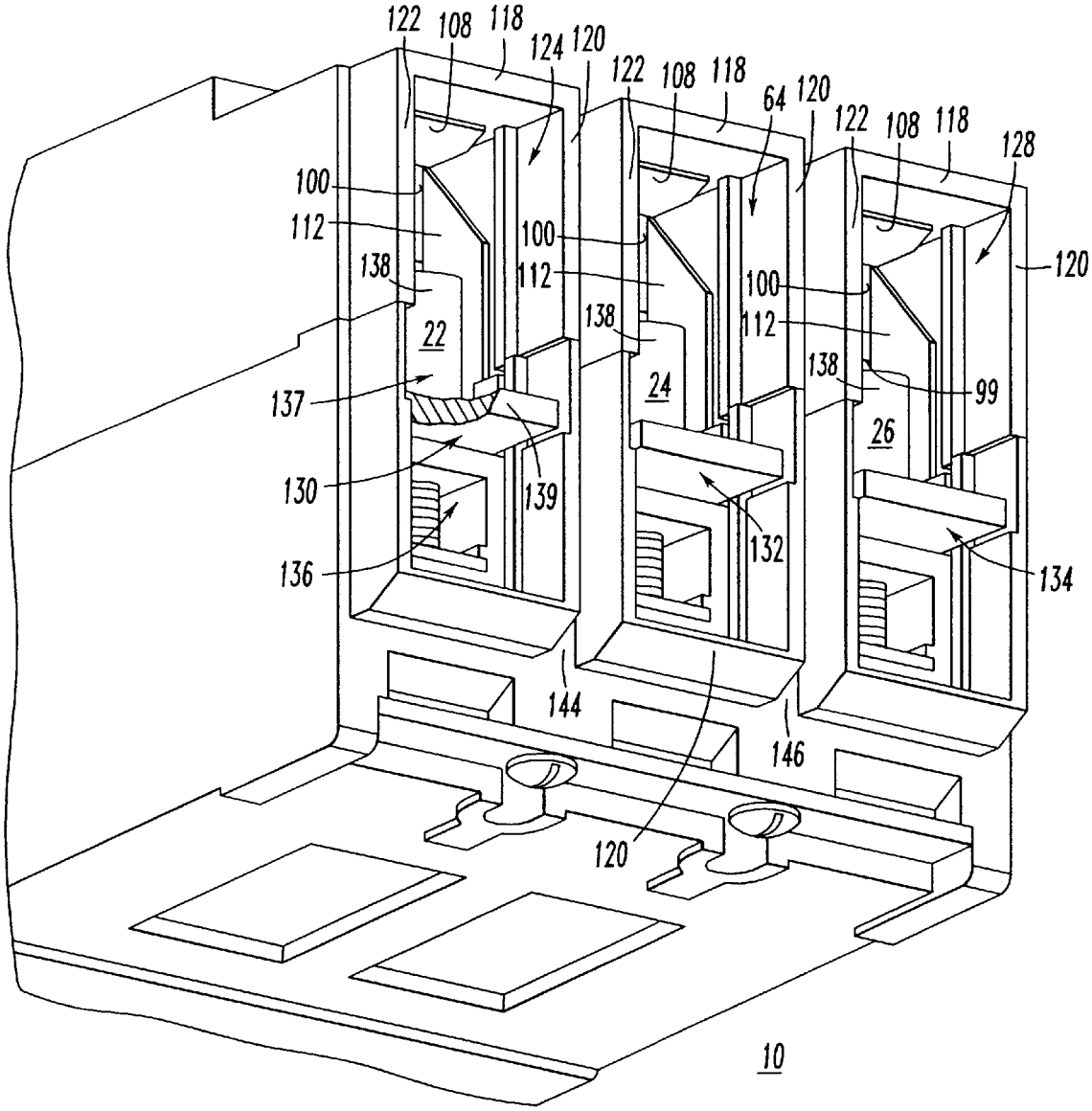
FIG. 5 is a isometric view of the circuit breaker of FIG. 1 showing the line terminals and corresponding barrier structures.
Figure 6:
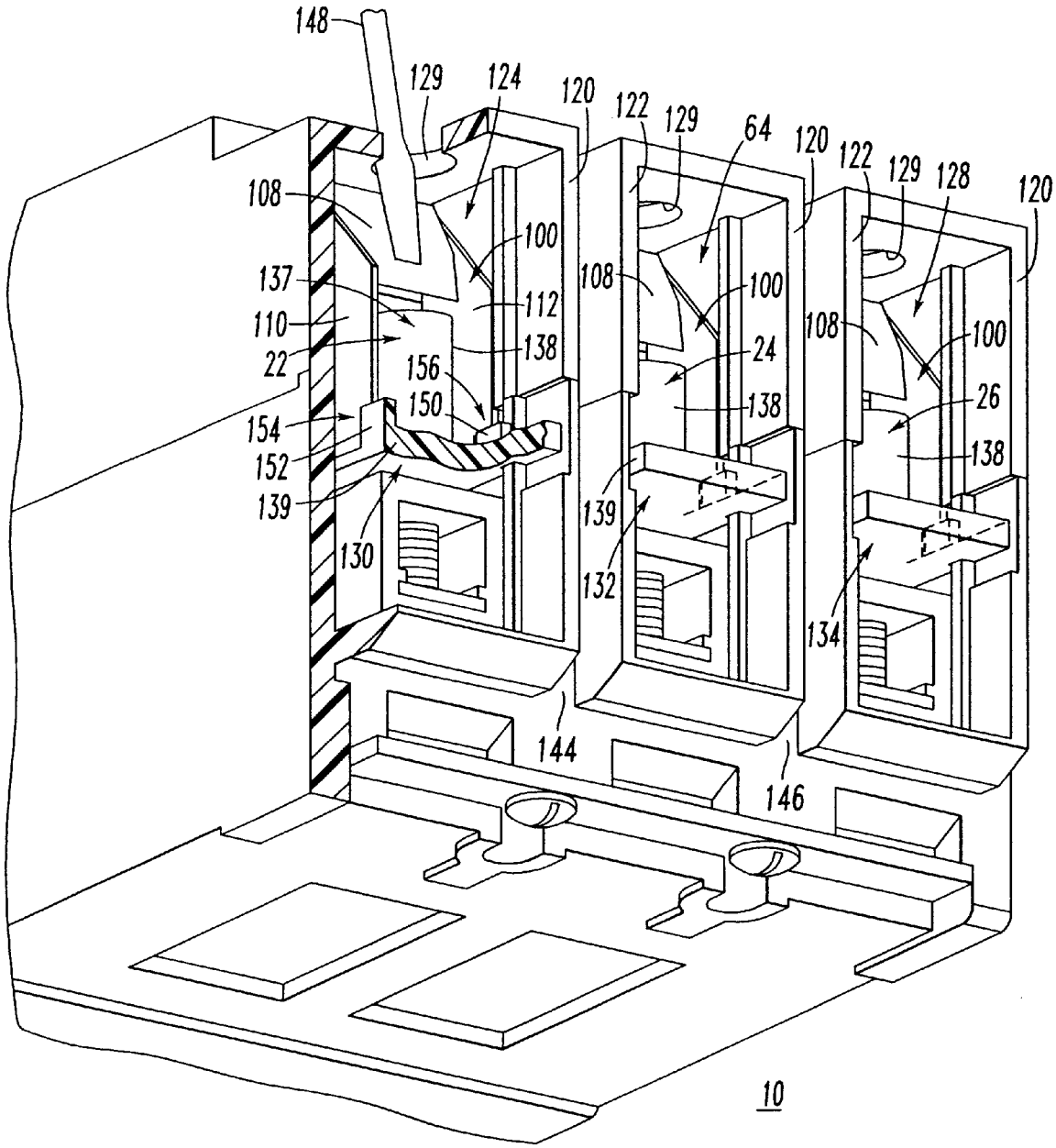
FIG. 6 is a isometric view similar to FIG. 5, but with the molded housing cut-away to show one leg of one of the barrier structures, and with the flaps of the barrier structures folded down to permit access to the line terminal through the terminal access aperture.

As shown in FIGS. 2, 5 and 6, the molded case 15 (FIG. 2) includes a first wall 118, an opposite second wall 119, a pair of side walls 120,122, and the barrier wall 99, which form compartments 124,64,128 for containing the respective line terminals 22,24,26. As best shown in FIG. 2, the first wall 118 has an aperture 129 aligned with the line terminal 24, and the barrier wall 99 has the opening 98 between the arc chamber 66 and the compartment 64. When a current interruption occurs, the separable contacts 36,38 are separated, and current, still being conducted therebetween, forms the electric arc 86, and the deionization plates 84 operate to extinguish this arc. In the process, ionized gases are formed, and exit through the opening 98 on the line side of the circuit breaker 10.

The line terminals 22,24,26 and the compartments 124, 64,128 form respective terminal pole units 130,132,134, each of which contains a terminal assembly 136; a plastic tube member 137 having a tube portion 138, a base portion 139 and the partition portion 74; and the member 100 mounted around tube portion 138. The tube portion 138 receives and protects a terminal screw 142, which is part of the terminal assembly 136 for securing a line connection (not shown) from a power source (not shown). As best shown in FIG. 2, the aperture 129 is in line with the tube portion 138. As shown in FIG. 5, the side walls 120 and 122 of the pole units 130 and 132, and of pole units 132 and 134 form longitudinal slots 144 and 146, respectively, between pole units 130–132 and 132–134.

The double-sided tape 116 of FIGS. 3 and 4 adheres to corresponding wall surfaces of the barrier wall 99, first wall 118 and the side walls 120,122 to retain the member 100 and its flap 108 in place. In particular, the tape 116 is adhered to a portion of each of the leg members 110,112 to adhere to a corresponding portion of each of the side walls 122,120, respectively. The tape 116 is also adhered to a portion of the flap 108 to adhere to a corresponding portion (i.e., to the right of the aperture 129 of FIG. 2) of the first wall 118. The tape 116 is further adhered to preferably all of the exemplary base portion 114 to adhere to a corresponding portion of the barrier wall 99, in order to preferably attach all of the base portion 114 of the member 100 thereto.

As best shown in FIG. 2, the flap 108 yieldably extends over the aperture 129 to prevent arc gases from flowing through the aperture 129 and thereby avoiding a phase-to-ground electrical breakdown between the line terminal 24 and any proximate electrical conductor 147 adjacent to the aperture 129. As shown in FIG. 6, the flap 108 is deflectable by a tool, such as the exemplary screwdriver 148, which is inserted through the aperture 129 for adjustment of the line terminal screw 142 (FIG. 2).

As shown in FIGS. 2 and 6, the base portion 139 of the tube member 137 preferably has protruding portions 152, 150 and each of the leg members 110,112 has a cut out portion 154,156, respectively, which mates with and, thus, further supports, aligns and holds the baffle member 100 in place within the compartment. The leg members 110,112 engage the pair of side walls 122,120 on opposite sides of the line terminal 24, thereby supporting the baffle member 100 within the compartment 64.

As shown in FIG. 5, the flap 108 closes the aperture 129 (FIG. 6) and thereby prevents electrical breakdown due to the passage of ionized gases therethrough. As the gas enters the compartment 64 of FIG. 2 through the opening 98 in the barrier wall 99, sufficient pressure is produced to not only move the flap 108 against the aperture 129, but to also provide an increased seal as the pressure increases. The flap 108 blocks the terminal access aperture 129 during circuit interruption, which prevents ionized gases from striking ground. Because the flap 108 is flexible, it allows access to the terminal screw 142 (FIG. 2) when the circuit breaker 10 is installed.

The legs 110,112 support the barrier 100, and the cut out portions 154,156 of these legs further support and align the barrier 100 in the compartment 64. The tape 116 prevents the barrier 100 from being dislodged or inadvertently removed. The top flap 108 bends down and allows the screwdriver 148 to deflect the same and access the terminal screw 142, which is aligned with the aperture 129. After the screwdriver 148 is removed, the cover flap 108 may return to its initial position (FIG. 5) when pushed by interruption gases. This initial position blocks the cover aperture 129, thereby preventing ionized gases from passing therethrough and striking ground. Finally, due to closing of the aperture 129 by the flap 108, the ionized arc gases move through the opening 98 under greater pressure into the opening 72 and, thus, into ambient air where the gas dissipates to harmless status.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breath of the claims appended and any and all equivalents thereof.

What is claimed is:

1. An electrical switching apparatus for automatically interrupting an overload current, said electrical switching apparatus comprising:

an electrically insulating housing;

an arc chamber within said housing;

line and load terminals;

separable contacts in series with said line and load terminals;

an operating mechanism for moving said separable contacts between an open position and a closed position, said open position of said contacts causing arcing therebetween and the development of ionized gases;

said housing including a plurality of walls forming a compartment for containing one of said terminals, with a first wall having an aperture for accessing said one of said terminals and a second wall having an opening between said chamber and said compartment, and a baffle member comprising a base portion, a flap and a pair of leg members, said flap extending over said aperture and being deflectable by a tool inserted through said aperture for adjustment of said one of said terminals, said leg members engaging some of the walls of said compartment, thereby supporting said baffle member within said compartment.

2. The electrical switching apparatus of claim 1 wherein said compartment includes a member having protruding portions; and wherein each of said leg members has a cut out portion which mates with a corresponding one of said protruding portions.

3. The electrical switching apparatus of claim 1 wherein said baffle member is a flat member which is folded three times to form said flap and said pair of leg members, with said flap and said leg members each being folded with respect to said base portion.

4. The electrical switching apparatus of claim 3 wherein said baffle member includes three perforated portions to form said three folds.

5. A circuit breaker comprising:

an electrically insulating housing;

line and load terminals;

separable contacts within said housing and electrically connected between said line and load terminals;

an arc chamber within said housing;

an operating mechanism adapted to move said separable contacts between open and closed positions within said chamber;

said housing including a first wall, an opposite second wall, a pair of side walls, and a barrier wall forming a compartment for containing one of said terminals, said barrier wall having an opening between said chamber and said compartment, said first wall having an aperture for accessing said one of said terminals; and a folded baffle member comprising a base portion, a flap and a pair of leg members, said flap extending over said aperture to prevent arc gases from flowing through said aperture and thereby avoiding a phase-to-ground electrical breakdown between said one of said terminals and an electrical conductor adjacent to said aperture, said flap being deflectable by a tool inserted through said aperture for adjustment of said one of said terminals, said leg members engaging said pair of side walls, thereby supporting said baffle member within said compartment.

6. The circuit breaker of claim 5 wherein said flap yieldably extends over said aperture.

7. The circuit breaker of claim 6 wherein said flap is composed of fiber sheet material.

8. The circuit breaker of claim 7 wherein said flap is a portion of a prefolded fiber sheet and has a portion for attachment to said barrier wall.

9. The circuit breaker of claim 5 wherein said compartment includes a member having protruding portions; and wherein each of said leg members has a cut out portion which mates with a corresponding one of said protruding portions.

10. The circuit breaker of claim 5 wherein said folded baffle member is a flat member which is folded three times to form said flap and said pair of leg members, with said flap and said leg members each being folded with respect to said base portion.

11. The circuit breaker of claim 10 wherein said folded baffle member includes three perforated portions to form said three folds.

12. The circuit breaker of claim 5 wherein an adhesive member is adhered to a portion of each of said leg members to adhere to a corresponding portion of each of said side walls.

13. The circuit breaker of claim 5 wherein an adhesive member is adhered to a portion of said flap to adhere to a corresponding portion of said first wall.

14. The circuit breaker of claim 5 wherein an adhesive member is adhered to said base portion to adhere to a corresponding portion of said barrier wall.

15. The circuit breaker of claim 14 wherein said adhesive member is double-sided tape, which adheres to all of said base portion.

16. The circuit breaker of claim 5 wherein said opening is below said barrier wall and adjacent said line terminal.

17. The circuit breaker of claim 5 wherein said base portion engages said barrier wall.

18. The circuit breaker of claim 5 wherein said leg members engage said pair of side walls on opposite sides of said line terminal.

19. The circuit breaker of claim 5 wherein said line terminal and said compartment form a terminal pole unit; wherein said line terminal includes a terminal assembly and a screw; and wherein said compartment includes a plastic tube, said tube receiving and protecting said screw.

20. The circuit breaker of claim 19 wherein said aperture is in line with said tube.

* * * * *